US011459914B2

(12) United States Patent
Takakusagi

(10) Patent No.: US 11,459,914 B2
(45) Date of Patent: Oct. 4, 2022

(54) TURBINE ROTOR FIXING DEVICE, TURBINE MODULE WHICH IS EQUIPPED WITH THE TURBINE ROTOR FIXING DEVICE, AND SHIPPING METHODS OF TURBINE MODULE

(71) Applicant: MITSUBISHI POWER, LTD., Yokohama (JP)

(72) Inventor: Tomohiko Takakusagi, Kanagawa (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/263,326

(22) PCT Filed: Feb. 12, 2020

(86) PCT No.: PCT/JP2020/005284

§ 371 (c)(1),
(2) Date: Jan. 26, 2021

(87) PCT Pub. No.: WO2020/170903

PCT Pub. Date: Aug. 27, 2020

(65) Prior Publication Data

US 2021/0148254 A1 May 20, 2021

(30) Foreign Application Priority Data

Feb. 22, 2019 (JP) ..... JP2019-030840

(51) Int. Cl.
*F01D 25/28* (2006.01)

(52) U.S. Cl.
CPC ..... *F01D 25/285* (2013.01); *F05D 2220/31* (2013.01); *F05D 2240/90* (2013.01); *F05D 2260/02* (2013.01)

(58) Field of Classification Search
CPC ..... F01D 25/24; F01D 25/285; F01D 25/26; F01D 25/265; F01D 25/28; F01K 13/00;
(Continued)

(56) References Cited

U.S. PATENT DOCUMENTS 6,203,270 B1 3/2001 Magoshi
2002/0197147 A1 12/2002 Kawai et al.
(Continued)

FOREIGN PATENT DOCUMENTS

EP 2860357 A1 4/2015
JP 62-267505 A 11/1987
(Continued)

OTHER PUBLICATIONS

International Search Report dated Apr. 7, 2020, issued in counterpart application No. PCT/JP2020/005284, w/English translation (6 pages).

*Primary Examiner* — Courtney D Heinle
*Assistant Examiner* — Ryan C Clark
(74) *Attorney, Agent, or Firm* — WHDA, LLP

(57) ABSTRACT

Provided are a turbine rotor fixing device capable of easily fixing a turbine rotor in a radial direction and an axial direction, and a shipping method of a turbine module. A fixing device (30) of a turbine rotor (11) includes a radial direction fixing jig (32) provided in a gland part (21A) that seals a clearance between the turbine rotor (11) and a turbine casing disposed to cover a periphery of the turbine rotor (11), to fix relative movement of the turbine rotor (11) to the gland part (21A) in a radial direction, and an axial direction fixing jig (31) provided between the turbine rotor (11) and the gland part (21A), to fix relative movement of the turbine rotor (11) to the gland part (21A) in an axis (X) direction.

5 Claims, 7 Drawing Sheets

(58) Field of Classification Search
CPC ..... F05D 2220/31; F05D 2240/90; F05D 2260/02
See application file for complete search history.

(56) References Cited

U.S. PATENT DOCUMENTS

| | | | | |
|---|---|---|---|---|
| 2017/0074109 | A1* | 3/2017 | Honda | F01D 5/30 |
| 2020/0011205 | A1* | 1/2020 | Sasaki | F01D 25/285 |
| 2021/0293153 | A1* | 9/2021 | Ueta | F01D 11/005 |
| 2021/0317756 | A1* | 10/2021 | Wilson | F01D 25/28 |

FOREIGN PATENT DOCUMENTS

| | | | |
|---|---|---|---|
| JP | 63-088207 | A | 4/1988 |
| JP | 2002-364309 | A | 12/2002 |
| JP | 2006-329057 | A | 12/2006 |
| JP | 4088369 | B2 | 5/2008 |
| JP | 5869173 | B2 | 2/2016 |
| JP | 6049582 | B2 | 12/2016 |

* cited by examiner

TURBINE ROTOR FIXING DEVICE, TURBINE MODULE WHICH IS EQUIPPED WITH THE TURBINE ROTOR FIXING DEVICE, AND SHIPPING METHODS OF TURBINE MODULE

TECHNICAL FIELD

The present disclosure relates to a turbine rotor fixing device, a turbine module which is equipped with the turbine rotor fixing device, and shipping methods of the turbine module.

BACKGROUND ART

For a high intermediate pressure (HIP) turbine (similarly to a case where a high pressure [HP] turbine and an intermediate pressure [IP] turbine are separate), built-in parts such as a turbine rotor and the like are incorporated in a turbine casing for modularization in a factory or the like, a turbine module (a modularized steam turbine) is installed on a shipping module support, and the turbine module is shipped to an on-site installing location, to reduce on-site assembly works. However, the steam turbine includes the turbine rotor that rotates or moves due to jolting, vibration or the like during the shipping, and hence it is necessary to support and fix the turbine rotor to the turbine casing with fixing metal fittings or the like.

As a technique of fixing the turbine rotor to the turbine casing, for example, in Patent Literature 1, reported is a technique of attaching a coupling jig constituted of two divided parts around a gland part of the rotor, holding the gland part inside and fastening the gland part with bolts and nuts to fix the rotor. In Patent Literature 2, reported is a technique of fixing the turbine rotor with temporary bolts through balance holes made in a governor side and a generator side of a turbine body for fixing and anti-rotation in an axial direction. In Patent Literature 2, it is described that a plurality of temporary rotor support rings divided along a circumference are inserted into a groove of an outer gland packing and a groove facing a labyrinth packing of a high intermediate pressure turbine rotor.

CITATION LIST

Patent Literature

[PTL 1] the Publication of Japanese Patent No. 4088369
[PTL 2] Japanese Unexamined Patent Application, Publication No. 1988-88207

SUMMARY OF INVENTION

Technical Problem

From the above circumstances, fixing of a turbine rotor (specifically, the fixing of the turbine rotor in a radial direction and an axial direction) is required to be facilitated. Furthermore, during shipping of a turbine module, in measuring a positional relation between the turbine rotor and a turbine casing in a factory and on a site, for example, occurrence of misalignment of the turbine rotor due to jolting, vibration or the like during the shipping is verified from a difference between measured values of a clearance before and after the shipping, the clearance being between a gland part (a part that seals from steam leakage out of the turbine casing, or inflow of outside air into a turbine, between the turbine rotor and the turbine casing at each end of the turbine casing) and the turbine rotor.

For measuring the clearance between the gland part and the turbine rotor, it is necessary to open an upper half of the gland part constituted of two divided upper and lower halves. However, the gland part is fastened to a flange part provided in the turbine casing or the like with a large number of bolts or the like, and hence removal of the upper half of the gland part requires a great deal of time and labor. Furthermore, once the clearance is measured prior to the shipping, it is difficult to measure the clearance during the shipping, and hence movement (misalignment) of the turbine rotor cannot be grasped every time. Therefore, integrity during the shipping cannot be verified until the site is reached, the upper half of the gland part is then opened and the clearance is measured. Consequently, inhibition of the misalignment of the turbine rotor requires a turbine rotor fixing device capable of easily fixing the turbine rotor in the radial direction and the axial direction, and a measuring device capable of efficiently checking, from the clearance, whether the misalignment of the turbine rotor occurs, without opening the gland part during the shipping.

An object of the present disclosure, which has been made in view of such situations, is to provide a turbine rotor fixing device capable of easily fixing a turbine rotor in a radial direction and an axial direction and a shipping method of the turbine module.

Solution to Problem

To achieve the above object, the present disclosure employs the following solutions.

A turbine rotor fixing device of the present disclosure comprises a radial direction fixing jig provided in a gland part that seals a clearance between a turbine rotor and a turbine casing disposed to cover a periphery of the turbine rotor, to fix relative movement of the turbine rotor to the gland part in a radial direction, and an axial direction fixing jig provided between the turbine rotor and the gland part, to fix relative movement of the turbine rotor to the gland part in an axial direction.

In the turbine rotor fixing device of the present disclosure, the turbine rotor is fixed to the turbine casing via the gland part separately in the radial direction and axial direction of the turbine rotor, with two jigs including the radial direction fixing jig and the axial direction fixing jig. Therefore, the relative movement of the turbine rotor in the radial direction and the relative movement in the axial direction can be fixed more easily than in the case where the relative movement of the turbine rotor in the radial direction and the relative movement in the axial direction are fixed with one jig. Furthermore, the jig to fix the relative movement of the turbine rotor in the radial direction and the jig to fix the relative movement in the axial direction can be separately manufactured, and hence the manufacturing of the jigs is facilitated.

Note that in the present disclosure, "to fix the relative movement in the radial direction" indicates that as the jig, for example, a jig (the radial direction fixing jig) sized in the radial direction so that a clearance between the jig and the turbine rotor and a clearance between the jig and the gland part have a dimension from 0 to 0.1 mm is used. Furthermore, "to fix the relative movement in the axial direction" indicates that as the jig, for example, a jig (the axial direction fixing jig) sized in the axial direction so that the clearance between the jig and the turbine rotor has a dimension from 0 to 1 mm is used.

In the above turbine rotor fixing device, it is preferable that an inner peripheral surface of the gland part is provided with one seal ring groove which is formed in the axial direction and into which the radial direction fixing jig is incorporated, and the other seal ring groove into which the axial direction fixing jig is incorporated.

If the gland part is provided with such seal ring grooves as described above, the radial direction fixing jig and the axial direction fixing jig can be incorporated in the seal ring grooves of the gland part. Furthermore, for example, if the above seal ring grooves are provided in the inner peripheral surface of the gland part in a circumferential direction, each of the jigs can be rotated along the circumferential direction to the clearance formed between the turbine rotor and the gland part, and inserted and incorporated in the seal ring groove. Specifically, in a case where one jig to fix the relative movement of the turbine rotor in the radial direction and the relative movement in the axial direction is used, portions of the jig that come in contact with the turbine rotor and the gland part increase to fix a position of the jig, and the portions come in contact in a plurality of directions. Consequently, it is difficult to rotate and insert the jig in the circumferential direction between the turbine rotor and the gland part. On the other hand, as in the present disclosure, two jigs including the jig to fix the relative movement of the turbine rotor in the radial direction and the jig to fix the relative movement in the axial direction are separately used, and hence portions of each jig that come in contact with the turbine rotor and the gland part can be appropriately reduced to necessary portions. Therefore, it is easy to rotate and insert each jig in the circumferential direction between the turbine rotor and the gland part.

In the turbine rotor fixing device, it is preferable that the axial direction fixing jig is located on a side of a rotor end of the turbine rotor outside the turbine casing away from the radial direction fixing jig, and the axial direction fixing jig is provided with a cutout in a measuring position of a clearance between the turbine rotor and the gland part so that the clearance is visible from the rotor end side of an end face of the turbine rotor away from the axial direction fixing jig.

If the axial direction fixing jig is provided with the cutout described above, the clearance between the turbine rotor and the gland part can be visually verified through the cutout from the position of the turbine rotor on the rotor end side (a bearing side) outside the turbine casing away from the axial direction fixing jig, without opening an upper half of the gland part, and the clearance can be easily measured with a measuring instrument or the like. Therefore, even after modularization of the turbine rotor and turbine casing, a clearance dimension between the turbine rotor and the gland part can be easily measured. Furthermore, the above clearance dimension is measured after assembly, before shipping and during the shipping of the turbine module. Consequently, it can be grasped, from a difference between respective measured values, whether the turbine rotor moves in the radial direction due to vibration or the like during the shipping, and a movement amount can be grasped. This facilitates quality assurance after the shipping. The clearance dimension between the turbine rotor and the gland part can be measured with the measuring instrument, such as a micrometer or a cylinder gauge.

In the above turbine rotor fixing device, it is preferable that one end of a measuring jig is inserted into the cutout and is attachable to the gland part on the rotor end side of the turbine rotor in the gland part, and the measuring jig is configured to measure a clearance between the end face of the turbine rotor on the rotor end side and the gland part in the axial direction.

If the measuring jig described above is attachable to the end face (e.g., a surface machined vertically to a turbine rotor shaft) of the turbine rotor on the rotor end side (the bearing side) in the gland part outside the turbine casing, the clearance between the turbine rotor and the gland part in the axial direction can be verified with the measuring jig from the position of the turbine rotor on the rotor end side, without opening the upper half of the gland part. Therefore, the clearance between the turbine rotor and the gland part in the axial direction is measured after the assembly, before the shipping and during the shipping of the turbine module. Consequently, it can be grasped, from a difference between respective measured values, whether the turbine rotor moves in the axial direction due to the vibration or the like during the shipping, and the movement amount can be grasped. This facilitates the quality assurance after the shipping. An example of the measuring jig is a block member having an L-shaped cross section and including one end extending in the axial direction and another end extending in the radial direction. Furthermore, a measuring method of misalignment includes, for example, attaching the measuring jig to the end face of the gland part by use of a magnet or the like so that the other end of the measuring jig having the L-shaped cross section faces the end face of the gland part orthogonal to the axial direction in parallel. Consequently, a distance between the other end of the measuring jig and the end face of the turbine rotor (a length of the turbine rotor in the axial direction) can be measured.

According to the present disclosure, provided is a turbine module comprising a turbine rotor, a turbine casing disposed to cover a periphery of the turbine rotor, and the above described turbine rotor fixing device to fix the relative movement of the turbine rotor to the turbine casing.

Since the turbine module of the present disclosure comprises the above described turbine rotor fixing device, the fixing of the position of the turbine rotor to the turbine casing and measuring of a mutual positional relation can be facilitated. Therefore, the turbine module having excellent operation properties can be obtained.

According to the present disclosure, provided is a shipping method of a turbine module by use of a turbine rotor fixing device comprising a radial direction fixing jig provided in a gland part that seals a clearance between a turbine rotor and a turbine casing disposed to cover a periphery of the turbine rotor, to fix relative movement of the turbine rotor to the gland part in a radial direction, and an axial direction fixing jig provided between the turbine rotor and the gland part, to fix relative movement of the turbine rotor to the gland part in an axial direction, the shipping method of the turbine module comprising a radial direction fixing step of fixing, with the radial direction fixing jig, the relative movement of the turbine rotor to the gland part in the radial direction, an axial direction fixing step of fixing, with the axial direction fixing jig, the relative movement of the turbine rotor to the gland part in the axial direction, and a shipping step of shipping the turbine module comprising the turbine rotor fixing device, the turbine rotor fixed by the turbine rotor fixing device, and the turbine casing.

In the shipping method of the turbine module of the present disclosure, the turbine rotor is fixed to the turbine casing via the gland part, separately in the radial direction and axial direction of the turbine rotor, with two jigs (in two steps) including the radial direction fixing jig (the radial direction fixing step) and the axial direction fixing jig (the axial direction fixing step). Therefore, the relative movement of the turbine rotor in the radial direction and the relative movement in the axial direction can be fixed more easily than in the case where the relative movement of the turbine rotor in the radial direction and the relative movement in the axial direction are fixed with one jig. Furthermore, since the jig to fix the relative movement of the turbine rotor in the radial direction and the jig to fix the relative movement in the axial direction can be separately manufactured, the manufacturing of the jigs can be facilitated.

Advantageous Effects of Invention

According to a turbine rotor fixing device and a shipping method of a turbine module of the present disclosure, a turbine rotor in a radial direction and an axial direction can be easily fixed. Furthermore, movement of the turbine rotor due to vibration during shipping of the turbine module can be inhibited.

DESCRIPTION OF EMBODIMENTS

Hereinafter, description will be made as to an embodiment of a turbine rotor fixing device, a turbine module which is equipped with the turbine rotor fixing device, and shipping methods of the turbine module according to the present disclosure, with reference to the drawings. In the present embodiment, an upper side indicates a vertical upper direction, and a lower side indicates a vertical lower direction.

[Turbine Module]

Hereinafter, description will be made as to a turbine module according to an embodiment of the present disclosure with reference to the drawings.

Figure 1:
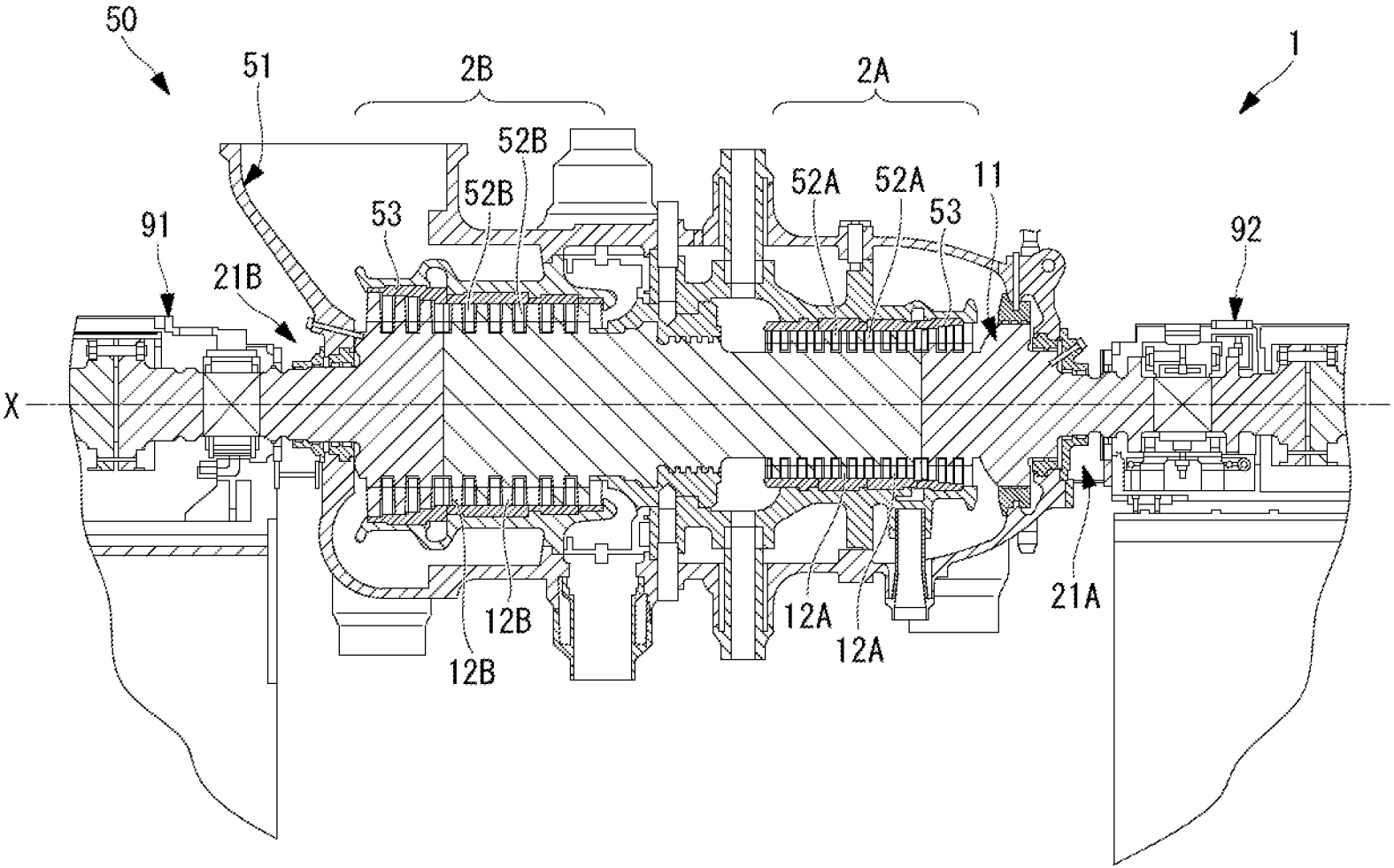
FIG. 1 is a schematic side cross-sectional view showing a turbine module according to an embodiment of the present disclosure.

FIG. 1 is a schematic side cross-sectional view showing the turbine module (a steam turbine or a high intermediate pressure turbine) according to the present embodiment.

As shown in FIG. 1, for a turbine module (the high intermediate pressure turbine) 1, a high pressure blade row (a rotating machine) 2A on one side (a paper surface right side) in an axis X direction and an intermediate pressure blade row (a rotating machine) 2B on the other side (a paper surface left side) in the axis X direction are constituted in one turbine module 1.

The high intermediate pressure turbine 1 includes a rotatably supported turbine rotor 11, and a stator 50. In the following description, an extending direction of an axis X will be referred to as "the axis X direction of the turbine rotor 11", a circumferential direction of the axis X will be referred to as "the circumferential direction of the turbine rotor 11", and a radial direction of the axis X will be referred to as "the radial direction of the turbine rotor 11".

The turbine rotor 11 includes rotating blade rows 12A, 12B constituted of a plurality of rotating blade stages. The stator 50 includes a turbine casing 51, stational blade rows 52A, 52B constituted of a plurality of stational blade stages, and the like.

The turbine rotor 11 extends through the stator 50 in the axis X direction, and has opposite rotor end sides in the axis X direction supported by bearings 91, 92 disposed outside the stator 50. In the present embodiment, the turbine module 1 is mounted on a module support (not shown) and shipped, in a state where the bearings 91, 92 are not included and shaft coupling is removed during the shipping of the turbine module 1.

The rotating blade rows 12A, 12B are constituted of a plurality of rotating blade stages, and each of the rotating blade stages is constituted of rotating blades arranged and held on an outer periphery of the turbine rotor 11 in the circumferential direction.

The stational blade rows 52A, 52B are constituted of a plurality of stational blade stages, and each of the stational blade stages is constituted of stational blades arranged in the circumferential direction and held on an inner periphery of a blade ring 53 fitted in the turbine casing 51. The rotating blade stages and stational blade stages are alternately arranged, to form the high pressure blade row 2A and the intermediate pressure blade row 2B, respectively.

The turbine casing 51 is disposed to cover a periphery of the turbine rotor 11, and is inserted into the turbine rotor 11. Opposite rotor ends of the turbine rotor 11 protrude from opposite ends of the turbine casing 51 in the axis X direction. Note that in the opposite ends of the turbine casing 51 in the axis X direction, any clearance formed between the turbine casing 51 and the turbine rotor 11 is sealed from an exterior part outside the turbine casing 51 by gland parts 21A, 21B.

An unshown seal ring is provided between the turbine casing 51 and the turbine rotor 11, and the clearance between the turbine casing 51 and the turbine rotor 11 is strictly managed to inhibit steam from leaking to the exterior part outside the turbine casing 51 or inhibit outside air from flowing inside.

[Turbine Rotor Fixing Device]

Next, description will be made as to a turbine rotor fixing device according to the present embodiment with reference to FIG. 2. The turbine rotor fixing device according to the present embodiment is applied, for example, to the gland parts 21A, 21B of FIG. 1.

Figure 2:
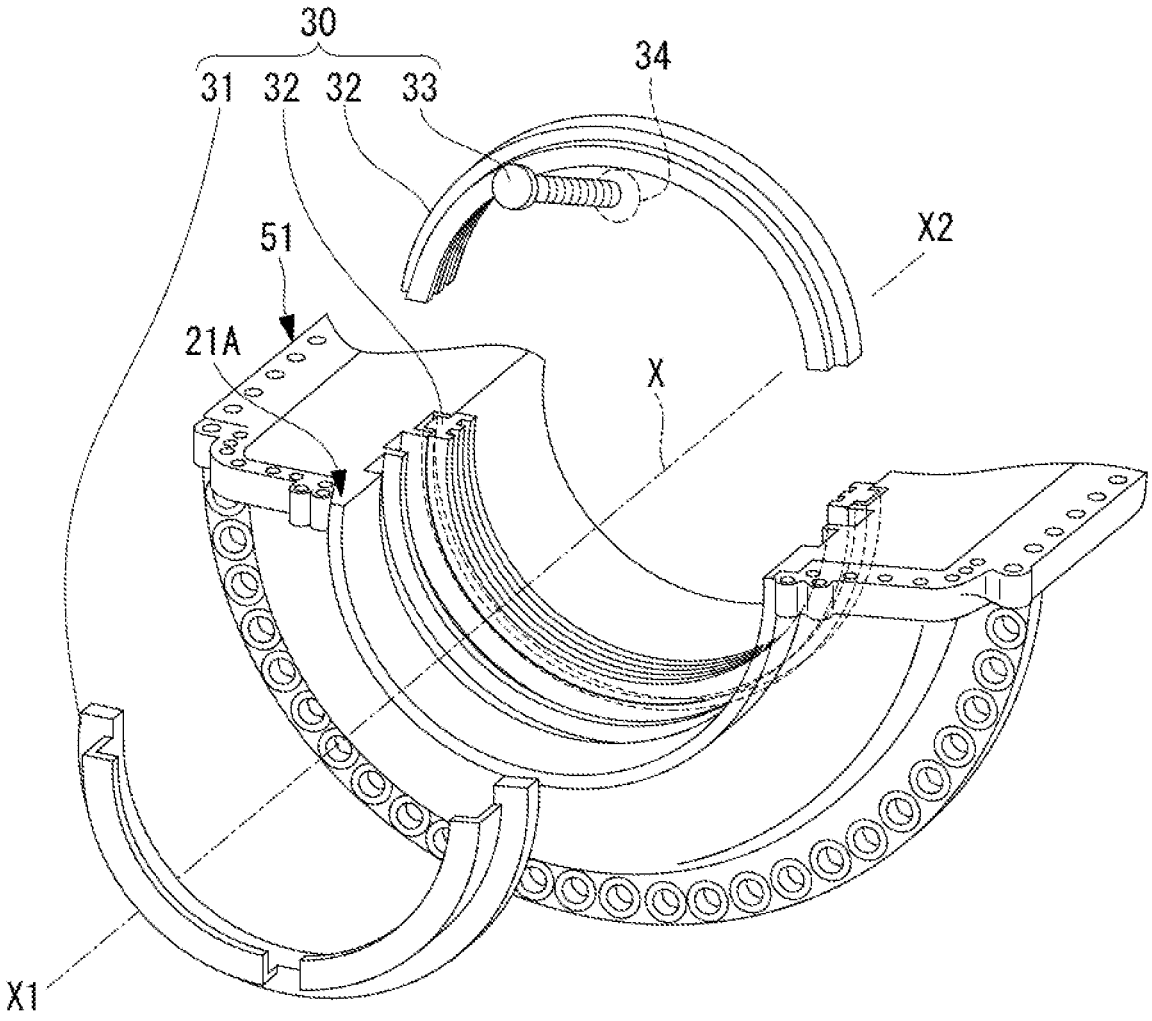
FIG. 2 is a schematic perspective view showing a state where an upper half of a gland part is removed, as seen from outside a paper surface right side of FIG. 1 to inside a turbine casing, in a vicinity of the gland part on the paper surface right side in the turbine module of FIG. 1.

FIG. 2 is a schematic perspective view showing a state where an upper half of the gland part 21A is removed, as seen from outside the paper surface right side of FIG. 1 to inside the turbine casing 51, in a vicinity of the gland part 21A on the paper surface right side in the turbine module of FIG. 1. Note that FIG. 2 omits drawing of the turbine rotor 11 for convenience of explanation. As shown in FIG. 2, the gland part 21A is provided with a turbine rotor fixing device 30 to fix relative movement of the turbine rotor 11 to the gland part 21A in the axis X direction, and relative movement of the turbine rotor 11 to the gland part 21A in the radial direction. The turbine rotor fixing device 30 comprises an axial direction fixing jig 31 to fix the relative movement of the turbine rotor 11 to the gland part 21A in the axis X direction, and a radial direction fixing jig 32 to fix the relative movement of the turbine rotor 11 to the gland part 21A in the radial direction. Examples of a material of the axial direction fixing jig 31 and the radial direction fixing jig 32 include metals such as an SS material and an SUS material.

The axial direction fixing jig 31 has a semi-circular shape, that is, a half-split ring shape. The axial direction fixing jig 31 is located on a rotor end X1 side of the turbine rotor 11 (outside the turbine casing 51 in the axis X direction) away from the radial direction fixing jig 32. Only one axial direction fixing jig 31 is disposed on a lower half side of the gland part 21A. After modularization, a seal ring is provided on an upper side of the axial direction fixing jig 31, and movement of the axial direction fixing jig 31 in the circumferential direction is fixed with this seal ring. A shape of the axial direction fixing jig 31 will be described later in detail.

The radial direction fixing jig 32 has a semi-circular shape, that is, a half-split ring shape. The radial direction fixing jig 32 is located on a rotor end X2 side of the turbine rotor 11 (inside the turbine casing 51 in the axis X direction) away from the axial direction fixing jig 31. Two radial direction fixing jigs 32 are provided on an upper half side and a lower half side of the divided gland part 21A, and are inserted so that an entire circumference of the turbine rotor 11 is surrounded with the two radial direction fixing jigs 32. A shape of the radial direction fixing jig 32 will be described later in detail.

As shown in FIG. 2, the turbine rotor fixing device 30 according to the present embodiment comprises a circumferential direction fixing jig (e.g., a rod-like member having a thread groove, such as a bolt) 33 that fixes movement of the turbine rotor 11 in the circumferential direction (a rotating direction). The circumferential direction fixing jig 33 is inserted to protrude from outside the turbine casing 51 (a position of the turbine rotor 11 on the rotor end X1 side away from the turbine casing 51) into the turbine casing 51. Specifically, in the present embodiment, the circumferential direction fixing jig 33 is inserted in a state where an inserting portion tip of the circumferential direction fixing jig 33 is inclined obliquely downward to the axis X, by use of a balance plug hole 34 for vibration adjustment provided in the turbine casing 51. The inserted circumferential direction fixing jig 33 comes in contact with a part of the turbine rotor 11, and is held and fixed so that the turbine rotor 11 does not rotate to the turbine casing 51. Thus, the movement of the turbine rotor 11 in the circumferential direction (the rotating direction) is fixed. Note that in the present disclosure, the circumferential direction fixing jig 33 is not indispensable.

Figure 4:
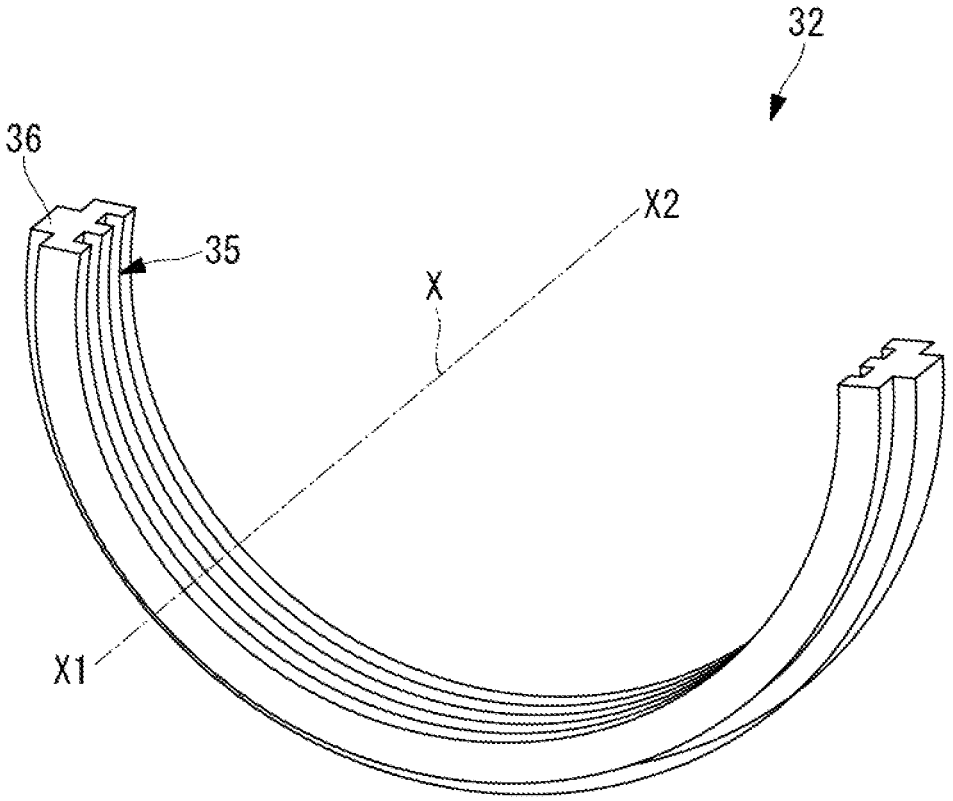
FIG. 4 is a perspective view showing an example of a radial direction fixing jig according to the embodiment of the present disclosure.
Figure 5:
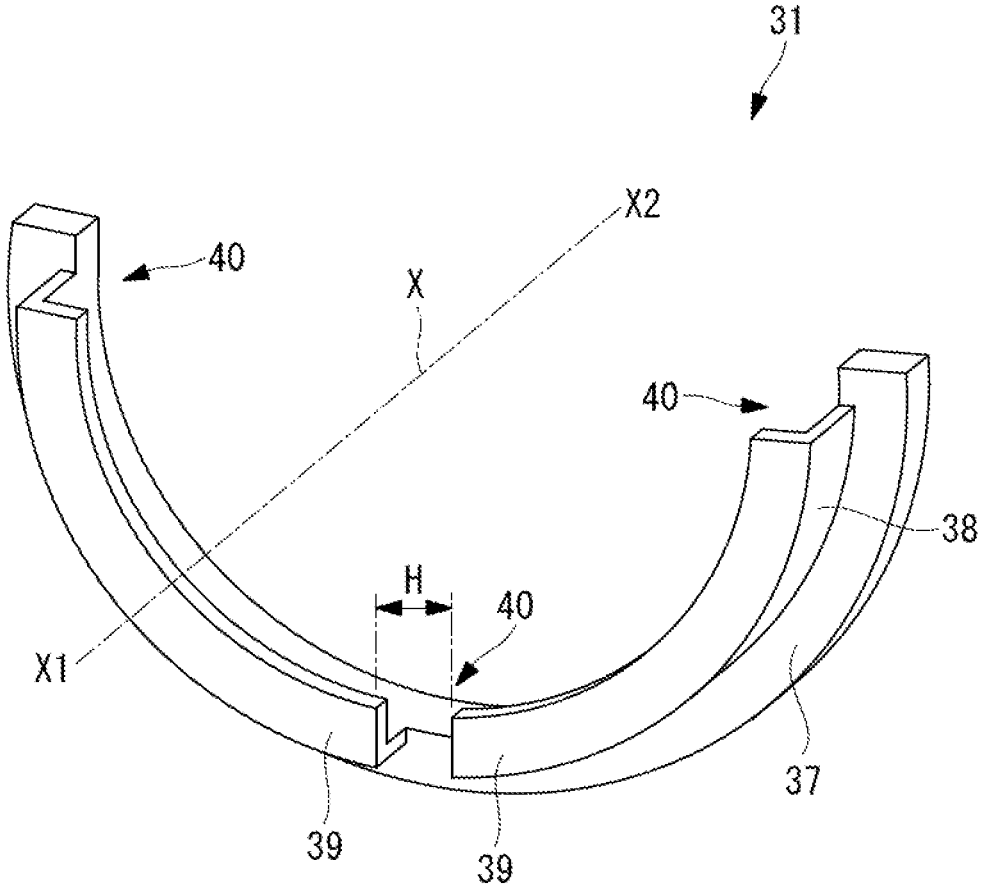
FIG. 5 is a perspective view showing an example of an axial direction fixing jig according to the embodiment of the present disclosure.

Next, description will be made as to a method of fixing the turbine rotor 11 by the turbine rotor fixing device 30 according to the present embodiment with reference to FIGS. 3 to 5. FIG. 4 is a perspective view showing an example of the radial direction fixing jig 32 according to the present embodiment. FIG. 5 is a perspective view showing an example of the axial direction fixing jig 31 according to the present embodiment. Note that FIGS. 3 to 5 also show the axis X for the convenience of explanation.

As shown in FIG. 4, the radial direction fixing jig 32 includes a turbine rotor side fitting part 35 that fits with an outer peripheral surface of the turbine rotor 11 described above, and a gland part side fitting part 36 that fits with an inner peripheral surface of the gland part 21A described above. The turbine rotor side fitting part 35 is formed so that an uneven part is formed in an inner peripheral surface of the radial direction fixing jig 32 and corresponds to an uneven shape of a fitting groove 13 (see FIG. 3) of the turbine rotor 11. The gland part side fitting part 36 is formed in a convex protrusion protruding outward from an outer peripheral surface of the radial direction fixing jig 32 in the radial direction.

As shown in FIG. 5, the axial direction fixing jig 31 includes a semi-circular fitting part 37 that fits with the inner peripheral surface of the gland part 21A described later. In a surface of the fitting part 37 on the rotor end X1 side, a protrusion 38 protruding from the fitting part 37 along the axis X direction is formed. In an end of the protrusion 38 toward the axis X direction (the end on a side opposite to the fitting part 37), a fixing part 39 is formed to protrude inward from the axis X in the radial direction. The fixing part 39 comes in contact with a surface (an after-mentioned end face 14) of the turbine rotor 11 described above on the rotor end X1 side and is locked.

The protrusion 38 and the fixing part 39 are not formed all around the fitting part 37, and are provided with cutouts 40 cut out to open a part (in the present embodiment, three parts in total in horizontal opposite end directions and on the vertical lower side seen from the rotor end X1 side) in the circumferential direction. There are not any special restrictions on positions and a number of the cutouts 40 to be provided.

After the axial direction fixing jig 31 is disposed, each cutout 40 is formed so that a clearance between the turbine rotor 11 and the gland part 21A can be visually verified from a position of the turbine rotor 11 on the rotor end X1 side to the end face 14 away from the axial direction fixing jig 31 and so that the clearance can be easily measured with a measuring instrument or the like. There are not any special restrictions on a width H of the cutout 40 (for the cutout 40 on the vertical lower side in FIG. 5, a length in a horizontal right-left direction), as long as the clearance between the turbine rotor 11 and the gland part 21A can be visually verified and the clearance can be measured with the measuring instrument or the like, and the width is, for example, from 20 mm to 60 mm.

Figure 3:
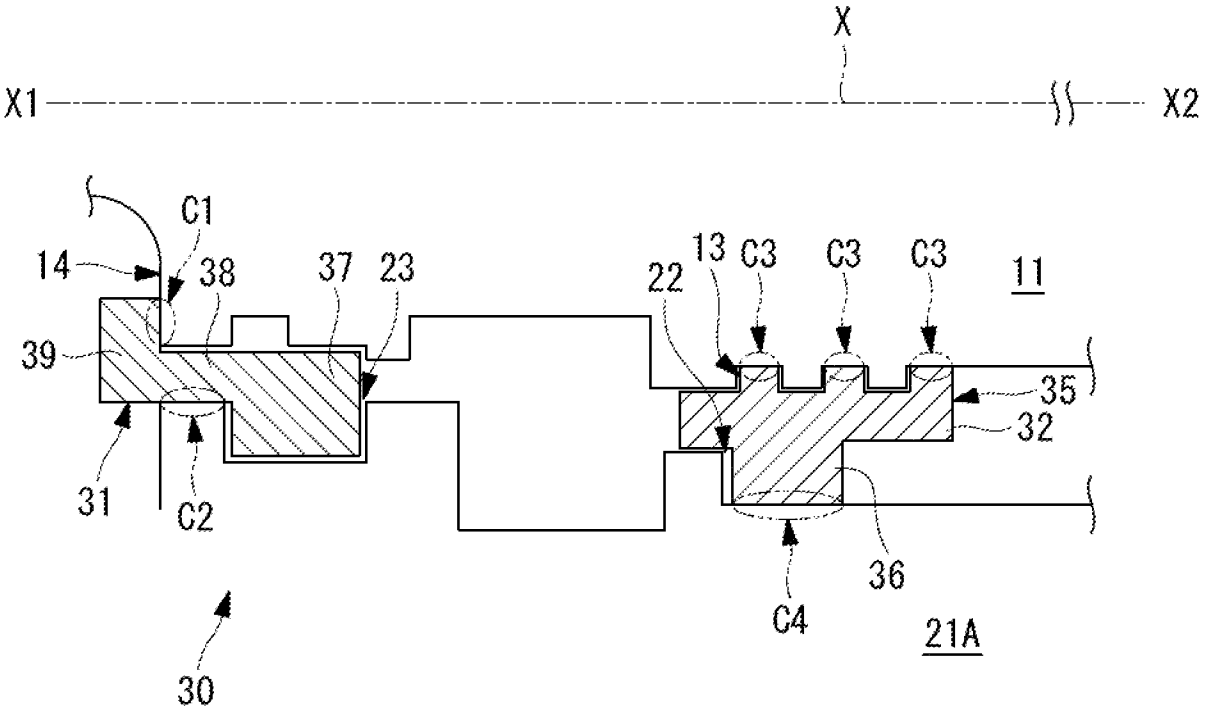
FIG. 3 is a partially cross-sectional view showing a state where a turbine rotor fixing device according to the embodiment of the present disclosure is provided between a turbine rotor and the gland part.

FIG. 3 is a partially cross-sectional view showing a state where the turbine rotor fixing device 30 according to the present embodiment is provided between the turbine rotor 11 and the gland part 21A. Specifically, FIG. 3 is a cross-sectional view cut to include a part of the axial direction fixing jig 31 including the protrusion 38 and the fixing part 39 (not to include a part in which the cutout 40 is formed). In FIG. 3, a paper surface left direction indicates a rotor end X1 direction of the turbine rotor 11 outside the turbine casing 51, and a paper surface right direction indicates a rotor end X2 direction of the turbine rotor 11 inside the turbine casing 51 (inside the gland part 21A).

As shown in FIG. 3, the inner peripheral surface of the gland part 21A is provided with a (one) seal ring groove 22 formed in the axis X direction, to fit with the gland part side fitting part 36 of the radial direction fixing jig 32, and a (the other) seal ring groove 23 that fits with the fitting part 37 of the axial direction fixing jig 31. The seal ring grooves 22, 23 are provided along the inner peripheral surface of the gland part 21A. The outer peripheral surface of the turbine rotor 11 is provided with the fitting groove 13 having the uneven shape that fits with the turbine rotor side fitting part (the uneven part) 35 of the radial direction fixing jig 32.

To fix the relative movement of the turbine rotor 11 in the axis X direction with the axial direction fixing jig 31, a clearance between the fixing part 39 of the axial direction fixing jig 31 and the surface of the turbine rotor 11 on the rotor end X1 side in a region C1 of FIG. 3 is adjusted into a dimension close to 0 (e.g., from 0 to 1 mm). To inhibit rattling of the axial direction fixing jig 31 itself (to fix a position of the axial direction fixing jig 31), a clearance between the protrusion 38 of the axial direction fixing jig 31 and the inner peripheral surface of the gland part 21A in a region C2 of FIG. 3 is adjusted into a dimension close to 0 (e.g., from 0 to 0.1 mm). For a clearance between the fitting part 37 of the axial direction fixing jig 31 and the inner peripheral surface of the gland part 21A, a tolerance is strictly managed, but a slight clearance is tolerated. The slight clearance is a clearance to such an extent that the fitting part 37 of the axial direction fixing jig 31 is movable in the axial direction and the radial direction to be easily inserted in the clearance between the turbine rotor 11 and the gland part 21A.

To fix the relative movement of the turbine rotor 11 in the radial direction with the axial direction fixing jig 31, a clearance between the turbine rotor side fitting part 35 of the radial direction fixing jig 32 (specifically, a convex portion of the turbine rotor side fitting part 35) and the fitting groove 13 (specifically, a concave portion of the fitting groove 13) of the turbine rotor 11 in a region C3 of FIG. 3 is adjusted into a dimension close to 0 (e.g., from 0 to 0.1 mm). For a similar reason, a clearance between the gland part side fitting part 36 of the radial direction fixing jig 32 and the inner peripheral surface of the gland part 21A (in a part in which the seal ring groove 22 is formed) in a region C4 of FIG. 3 is adjusted into a dimension close to 0 (e.g., from 0 to 0.1 mm).

An example of a method of disposing the axial direction fixing jig 31 in the seal ring groove 23 or disposing the radial direction fixing jig 32 in the seal ring groove 22 is a method of rotating each jig in the circumferential direction to insert the jig in the upper half of the divided gland part 21A, but the method is not limited to this example.

The turbine rotor fixing device 30 described above is also provided in the gland part 21B of FIG. 1.

Next, description will be made as to a method of verifying a length of the clearance between the turbine rotor 11 and the gland part 21A, and misalignment between the turbine rotor 11 and the gland part 21A in the axis X direction, with reference to FIGS. 6 and 7.

Figure 6:
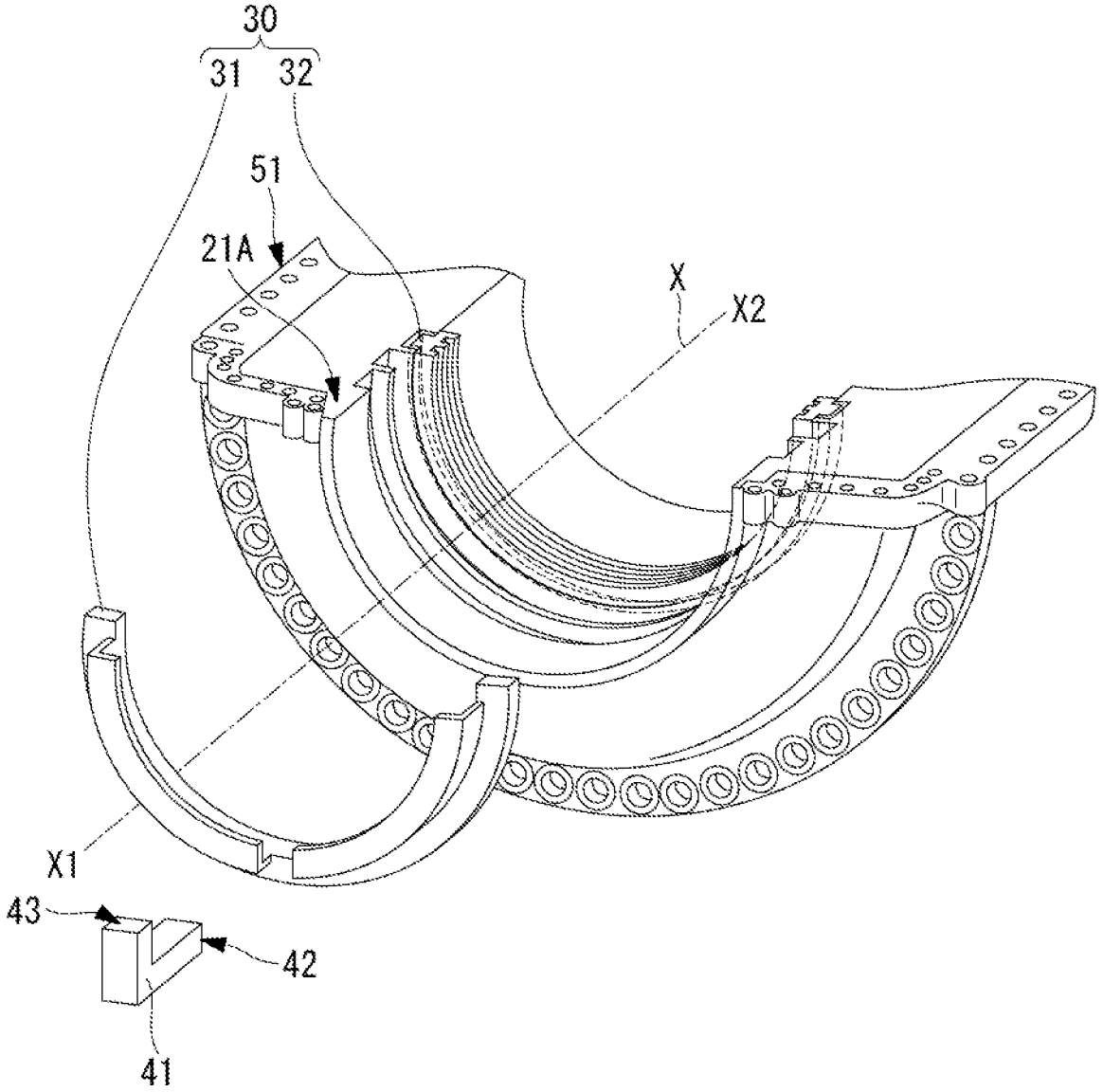
FIG. 6 is a partially schematic perspective view showing a state where a measuring jig is attached to the gland part, as seen from outside the paper surface right side of FIG. 1 to inside the turbine casing, in the vicinity of the gland part on the paper surface right side in the turbine module of FIG. 1.

FIG. 6 is a partially schematic perspective view showing a state where a measuring jig is attached to the gland part, as seen from outside the paper surface right side of FIG. 1 to inside the turbine casing 51, in the vicinity of the gland part on the paper surface right side in the turbine module of FIG. 1. Note that FIG. 6 omits drawing of the turbine rotor 11 for the convenience of explanation. Furthermore, FIG. 6 also shows the axis X for the convenience of explanation. As shown in FIG. 6, one end 42 of a measuring jig 41 is attachable to come in contact with the turbine rotor 11 on the rotor end X1 side in the gland part 21A. As the measuring jig 41, for example, a block body having an L-shaped cross section and including the one end 42 extending in the axis X direction and another end 43 extending in the radial direction may be used.

Figure 7:
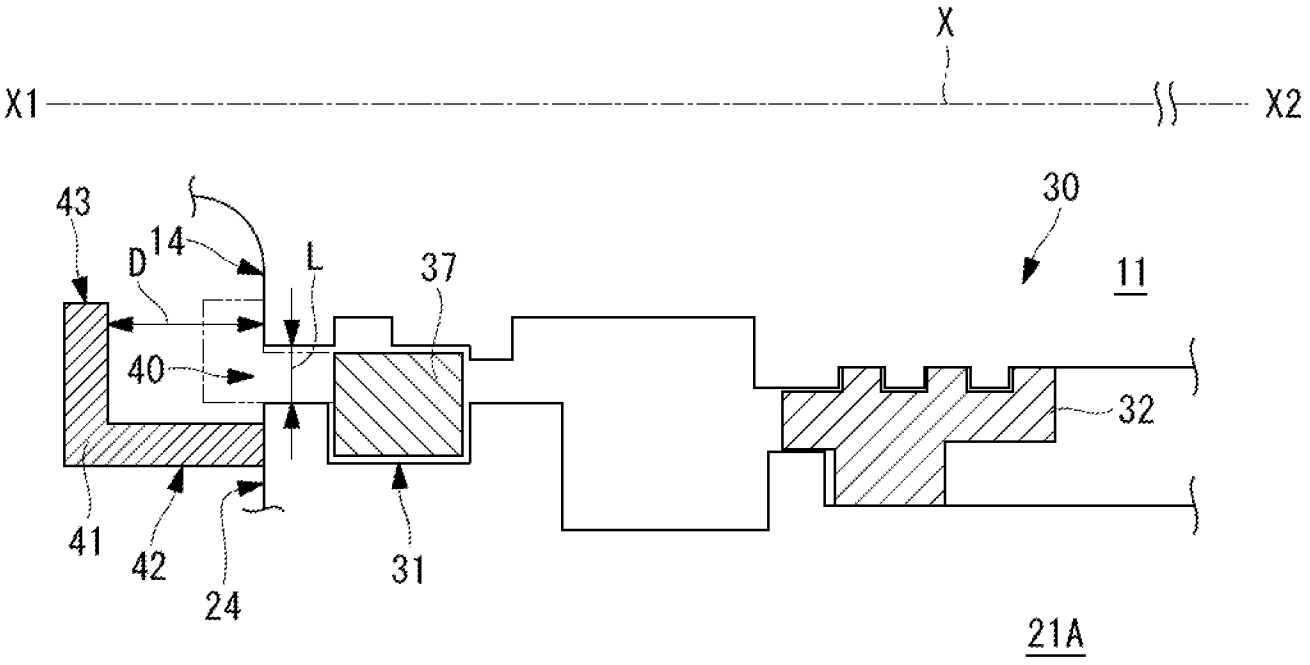
FIG. 7 is a partially cross-sectional view showing a state where the measuring jig is attached to the gland part.

FIG. 7 is a partially cross-sectional view showing a state where the measuring jig 41 is attached to the gland part 21A. Specifically, FIG. 7 is a cross-sectional view of the axial direction fixing jig 31 cut to include a part in which the cutout 40 is formed. In FIG. 7, a paper surface left direction indicates the rotor end X1 direction of the turbine rotor 11 outside the turbine casing 51, and a paper surface right direction indicates the rotor end X2 direction of the turbine rotor 11 inside the turbine casing 51 (inside the gland part 21A). FIG. 7 also shows the axis X for the convenience of explanation.

Since the axial direction fixing jig 31 is provided with the cutout 40, the clearance between the turbine rotor 11 and the gland part 21A can be visually verified through the cutout 40 from the position of the turbine rotor 11 on the rotor end X1 side away from the axial direction fixing jig 31, without opening the upper half of the gland part 21A, and the clearance can be easily measured with the measuring instrument or the like. A clearance dimension L between the turbine rotor 11 and the gland part 21A can be measured, for example, with the measuring instrument, such as a micrometer or a cylinder gauge.

The measuring jig 41 is configured to measure a clearance in the end face 14 of the turbine rotor 11 on the rotor end X1 side. During the measuring, the one end 42 of the measuring jig 41 is attached to come in contact with a reference surface 24 on the rotor end X1 side in the gland part 21A with a magnet or the like. At this time, the other end 43 of the measuring jig 41 is adjusted to face, in parallel, the end face 14 of the turbine rotor 11 and the end face of the gland part orthogonal to the axis X direction. In this state, a distance D between the other end 43 of the measuring jig 41 and the end face 14 of the turbine rotor 11 (a length of the turbine rotor 11 in the axis X direction) is measured with the micrometer or the like, and a measured value is compared with a measured value prior to start of the shipping. Consequently, the clearance in the turbine rotor 11 in the axial direction is measured. Note that the other end 43 of the measuring jig 41 does not have to be disposed to face, in parallel, the end face 14 of the turbine rotor 11 and the end face of the gland part orthogonal to the axis X direction, and the measuring with the measuring jig 41 may be performed in another mode.

[Shipping Method of Turbine Module]

Next, a shipping method of the turbine module according to the present embodiment will be described.

Hereinafter, a case of shipping the turbine module 1 shown in FIG. 1 will be described as an example, but the method is not limited to this example.

(Radial Direction Fixing Step)

A radial direction fixing step includes fixing, with the radial direction fixing jig 32, the relative movement of the turbine rotor 11 to the gland parts 21A, 21B in the radial direction.

(Axial Direction Fixing Step)

An axial direction fixing step includes, after performing the radial direction fixing step, inserting the axial direction fixing jig 31, to fix the relative movement of the turbine rotor 11 to the gland parts 21A, 21B in the axial direction.

(Shipping Step)

The turbine module 1 is shipped after completing the fixing of the position of the turbine rotor 11 by the turbine rotor fixing device 30. In the present embodiment, during the shipping of the turbine module 1, the bearings 91, 92 are removed, and the turbine module 1 is fixed to the module support (not shown) or the like, mounted on a moving means, and shipped.

With the above described configuration, according to the present embodiment, the following operations and effects are exhibited.

According to the turbine rotor fixing device 30 of the present embodiment, the turbine rotor 11 is fixed to the turbine casing 51 via the gland parts 21A, 21B separately in the radial direction and axial direction of the turbine rotor, with two jigs including the radial direction fixing jig 32 and the axial direction fixing jig 31. Therefore, the relative movement of the turbine rotor 11 in the radial direction and the relative movement in the axis X direction can be fixed more easily than in the case where the relative movement of the turbine rotor 11 in the radial direction and the relative movement in the axis X direction are fixed with one jig. Furthermore, the jig to fix the relative movement of the turbine rotor 11 in the radial direction and the jig to fix the relative movement in the axis X direction can be separately manufactured, and hence the manufacturing of the jigs is facilitated.

If each of the gland parts 21A, 21B is provided with the seal ring grooves 22, 23, the radial direction fixing jig 32 and the axial direction fixing jig 31 can be incorporated in the seal ring grooves 22, 23 of the gland part 21A, 21B. Furthermore, for example, if the seal ring grooves 22, 23 are provided in the inner peripheral surface of the gland part 21A, 21B in the circumferential direction, each jig can be rotated along the circumferential direction to the clearance formed between the turbine rotor 11 and the gland part 21A, 21B, and inserted and incorporated in the seal ring groove 22, 23. Specifically, in a case where one jig to fix the turbine rotor 11 in the radial direction and the axial direction is used, portions of the jig that come in contact with the turbine rotor 11 and the gland part 21A, 21B increase to fix the position of the jig, and the portions come in contact in a plurality of directions. Consequently, it is difficult to rotate and insert the jig in the circumferential direction between the turbine rotor 11 and the gland part 21A, 21B. On the other hand, in a case where, as in the present embodiment, two jigs including the jig to fix the relative movement of the turbine rotor 11 in the radial direction and the jig to fix the relative movement in the axis X direction are separately used, portions of each jig that come in contact with the turbine rotor 11 and the gland part 21A, 21B can be appropriately reduced to necessary portions. Consequently, it is easy to rotate and insert each jig in the circumferential direction between the turbine rotor 11 and the gland part 21A, 21B.

If the axial direction fixing jig 31 is provided with the cutout 40, the clearance between the turbine rotor 11 and the gland part 21A, 21B can be visually verified through the cutout 40 from the position of the turbine rotor 11 on the rotor end X1 side outside the turbine casing 51 away from the axial direction fixing jig 31, without opening the upper half of the gland part 21A, 21B, and the clearance can be easily measured with the measuring instrument or the like. Therefore, even after the modularization of the turbine rotor 11 and turbine casing 51, the clearance dimension L between the turbine rotor 11 and the gland part 21A, 21B can be easily measured. Furthermore, the above clearance dimension L is measured after assembly, before the shipping and during the shipping of the turbine module 1. Consequently, it can be grasped, from a difference between respective measured values, whether the turbine rotor 11 moves in the radial direction due to vibration or the like during the shipping, and a movement amount can be grasped. This facilitates quality assurance after the shipping.

If the measuring jig 41 is attachable to the rotor end X1 side of the turbine rotor 11 in the gland part 21A, 21B outside the turbine casing 51, the clearance between the turbine rotor 11 and the gland part 21A, 21B in the axis X direction can be verified with the measuring jig 41 from the position of the turbine rotor 11 on the rotor end X1 side, without opening the upper half of the gland part 21A, 21B. Therefore, even after the modularization of the turbine rotor 11 and the turbine casing 51, the clearance between the turbine rotor 11 and the gland part 21A, 21B in the axis X direction can be easily measured. Furthermore, the distance D between the measuring jig 41 and the turbine rotor 11 is measured after the assembly, before the shipping and during the shipping of the turbine module 1. Consequently, it can be grasped, from the difference between the respective measured values, whether the turbine rotor 11 moves in the axis X direction due to the vibration or the like during the shipping, and the movement amount can be grasped. This facilitates the quality assurance after the shipping.

Since the turbine module 1 of the present embodiment comprises the turbine rotor fixing device 30, the fixing of the position of the turbine rotor 11 to the turbine casing 51 and measuring of a mutual positional relation can be facilitated. Therefore, the turbine module 1 having excellent operation properties can be obtained.

In the shipping method of the turbine module 1 of the present embodiment, the turbine rotor 11 is fixed to the turbine casing 51 via the gland parts 21A, 21B, separately in the radial direction and axial direction of the turbine rotor, with two jigs (in two steps) including the radial direction fixing jig 32 (the radial direction fixing step) and the axial direction fixing jig 31 (the axial direction fixing step). Therefore, the relative movement of the turbine rotor 11 in the radial direction and the relative movement in the axis X direction can be fixed more easily than in the case where the relative movement of the turbine rotor 11 in the radial direction and the relative movement in the axis X direction are fixed with one jig. Furthermore, since the jig to fix the relative movement of the turbine rotor 11 in the radial direction and the jig to fix the relative movement in the axis X direction can be separately manufactured, the manufacturing of the jigs can be facilitated.

Note that in the above described embodiment, the case of using the jigs having the semi-circular shape as the axial direction fixing jig 31 and the radial direction fixing jig 32 has been described as an example, but the shape of each jig is not limited to this example. Furthermore, there are not any special restrictions on the number of the respective jigs. That is, a number of axial direction fixing jigs 31 is not limited to one, and may be two or more. Furthermore, a number of the radial direction fixing jig 32 is not limited to two in an up-down direction, and may be three or more.

REFERENCE SIGNS LIST

1 Turbine module (a high intermediate pressure turbine)
2A High pressure blade row (a rotating machine)
2B Intermediate pressure blade row (a rotating machine)
11 Turbine rotor
12A, 12B Rotating blade row
13 Fitting groove
14 End face
21A, 21B Gland part
22 (one) Seal ring groove
23 (the other) Seal ring groove
24 Reference surface
30 Turbine rotor fixing device
31 Axial direction fixing jig (a jig)
32 Radial direction fixing jig (a jig)
33 Circumferential direction fixing jig (a jig)
34 Balance plug hole
35 Turbine rotor side fitting part
36 Gland part side fitting part
37 Fitting part
38 Protrusion

39 Fixing part
40 Cutout
41 Measuring jig
42 One end
43 The other end
50 Stator
51 Turbine casing
52*a*, 52*b* Stational blade row
53 Blade ring
91, 92 Bearing
D Distance
H Width
L Clearance dimension
X Axis
X1, X2 Rotor end

The invention claimed is:

1. A turbine rotor fixing device comprising:

a radial direction fixing jig provided in a gland part that seals a clearance between a turbine rotor and a turbine casing disposed to cover a periphery of the turbine rotor, to fix relative movement of the turbine rotor to the gland part in a radial direction, and an axial direction fixing jig provided between the turbine rotor and the gland part, to fix relative movement of the turbine rotor to the gland part in an axial direction, wherein an inner peripheral surface of the gland part is provided with one seal ring groove which is formed in the axial direction and into which the radial direction fixing jig is incorporated, and an other seal ring groove into which the axial direction fixing jig is incorporated.

2. The turbine rotor fixing device according to claim 1, wherein the axial direction fixing jig is located on a side of a rotor end of the turbine rotor outside the turbine casing away from the radial direction fixing jig, and the axial direction fixing jig is provided with a cutout in a measuring position of a clearance between the turbine rotor and the gland part so that the clearance is visible from the rotor end side of an end face of the turbine rotor away from the axial direction fixing jig.

3. The turbine rotor fixing device according to claim 2, wherein one end of a measuring jig is inserted into the cutout and is attachable to the gland part on the rotor end side of the turbine rotor in the gland part, and the measuring jig is configured to measure a clearance between the end face of the turbine rotor on the rotor end side and the gland part in the axial direction.

4. A turbine module comprising:

a turbine rotor, a turbine casing disposed to cover a periphery of the turbine rotor, and the turbine rotor fixing device according to claim 1 to fix the relative movement of the turbine rotor to the turbine casing.

5. A shipping method of a turbine module by use of a turbine rotor fixing device comprising a radial direction fixing jig provided in a gland part that seals a clearance between a turbine rotor and a turbine casing disposed to cover a periphery of the turbine rotor, to fix relative movement of the turbine rotor to the gland part in a radial direction, and an axial direction fixing jig provided between the turbine rotor and the gland part, to fix relative movement of the turbine rotor to the gland part in an axial direction, the shipping method of the turbine module comprising:

a radial direction fixing step of fixing, with the radial direction fixing jig, the relative movement of the turbine rotor to the gland part in the radial direction, an axial direction fixing step of fixing, with the axial direction fixing jig, the relative movement of the turbine rotor to the gland part in the axial direction, and a shipping step of shipping the turbine module comprising the turbine rotor fixing device, the turbine rotor fixed by the turbine rotor fixing device, and the turbine casing, wherein an inner peripheral surface of the gland part is provided with one seal ring groove which is formed in the axial direction and into which the radial direction fixing jig is incorporated, and an other seal ring groove into which the axial direction fixing jig is incorporated.

* * * * *